United States Patent [19]

Dove

[11] Patent Number: 4,770,744

[45] Date of Patent: Sep. 13, 1988

[54] HEADBOX SLICE LIP ADJUSTMENT DEVICE

[75] Inventor: Norman F. Dove, North Vancouver, Canada

[73] Assignee: Devron-Hercules Inc., North Vancouver, Canada

[21] Appl. No.: 940,178

[22] Filed: Dec. 10, 1986

Related U.S. Application Data

[63] Continuation of Ser. No. 789,913, Oct. 16, 1985, abandoned, which is a continuation of Ser. No. 501,498, Jun. 6, 1983, abandoned.

[30] Foreign Application Priority Data

Dec. 23, 1982 [CA] Canada ..... 418429

[51] Int. Cl.[4] ..... D21F 1/02; D21F 1/06; F15B 7/00

[52] U.S. Cl. ..... 162/259; 162/DIG. 6; 60/527; 60/533

[58] Field of Search ..... 60/527, 528, 325, 534, 60/583, 594; 162/344, 347, 259

[56] References Cited

U.S. PATENT DOCUMENTS

| | | | |
|---|---|---|---|
| 1,697,432 | 1/1929 | Martin | 60/528 |
| 1,862,569 | 6/1932 | Gargan | 60/534 |
| 1,934,206 | 11/1933 | Page | 60/594 |
| 2,476,022 | 7/1949 | Bennett | 60/528 |
| 2,951,007 | 8/1960 | Lippke | 162/259 |
| 3,213,625 | 10/1965 | Worthen | 60/594 |
| 3,540,479 | 11/1970 | Thompson | 60/527 |
| 3,635,016 | 1/1972 | Benson | 60/528 |
| 4,406,740 | 9/1983 | Brieu | 162/397 |

FOREIGN PATENT DOCUMENTS

| | | | |
|---|---|---|---|
| 0045250 | 2/1982 | European Pat. Off. | 60/528 |
| 757282 | 12/1933 | France | 60/594 |
| 1375990 | 12/1972 | United Kingdom | 60/583 |

*Primary Examiner*—Robert E. Garrett
*Assistant Examiner*—George Kapsalas

[57] ABSTRACT

A first flexible vessel of a first cross section communicates with the rod and a second flexible vessel of a second cross section, different from the first cross section communicates with the first vessel. A substantially incompressible fluid is contained in the first and second vessels. Movement of a heated rod against the first expansible vessel moves liquid to the second expansible vessel, the differing cross section ensuring that the longitudinal movement of the second vessel is different from that of the rod.

14 Claims, 3 Drawing Sheets

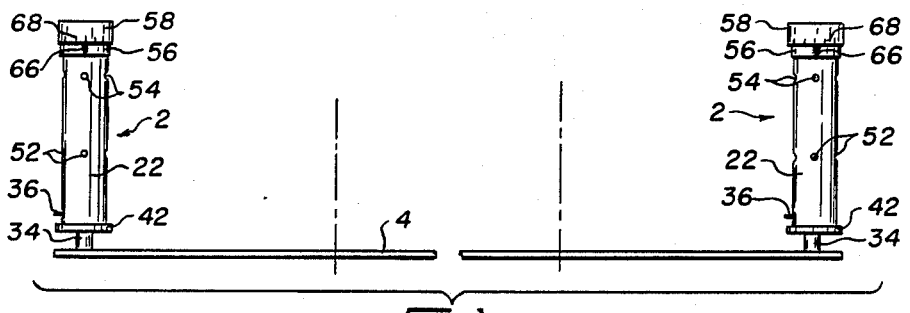
Fig. 1.
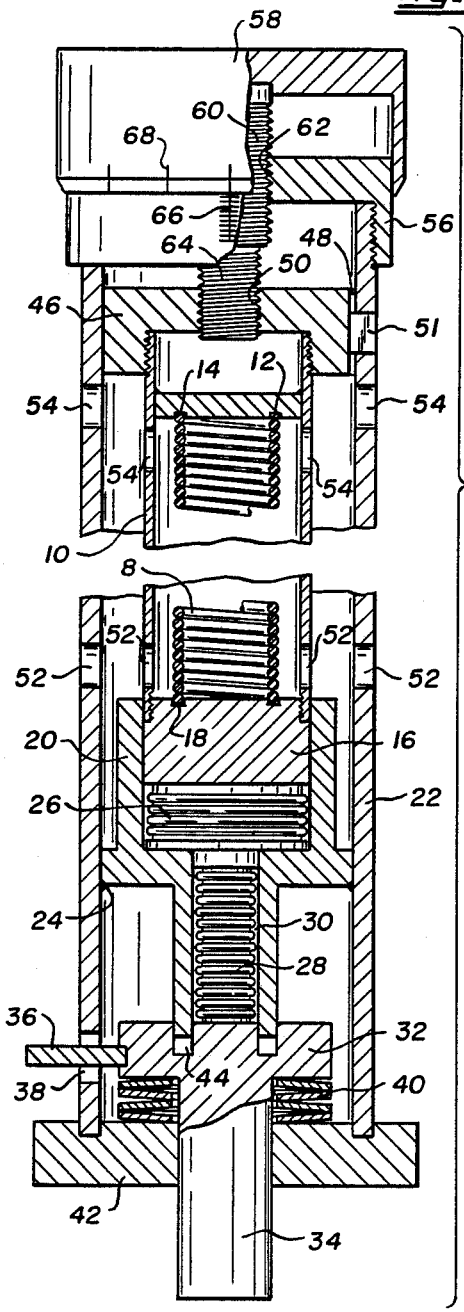
Fig. 2.
Fig. 3.
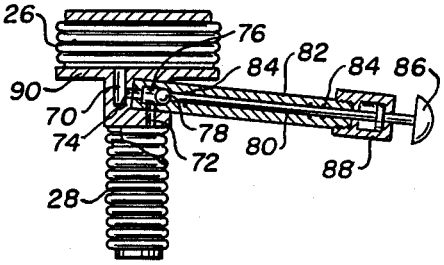

HEADBOX SLICE LIP ADJUSTMENT DEVICE

This is a continuation of copending application Ser. No. 789,913 filed on Oct. 16, 1985, now abandoned, which was a continuation of application Ser. No. 501,498 filed on June 6, 1983, now abandoned.

FIELD OF THE INVENTION

This invention relates to a control mechanism useful where a sensitive, reproducible control of a mechanism is required but of particular application in the control of the lip of a head box slice on a paper machine.

Adjustments to less than thousands of an inch are frequently required in many industrial applications. The following specification is directed specifically to the control of the lip of the head box slice but it will be appreciated that the invention is applicable in any circumstances where precise, predictable control is required.

DESCRIPTION OF THE PRIOR ART

The essence of a paper making machine is the wire section upon which the paper sheet is formed. Although highly complex technology is practiced on the materials prior to the dispersion on the wire section and after the wire section the essential forming of the paper sheet takes place on the wire section. The fibre suspension from which the paper sheet is formed is applied to the wire section through a head box. Although head boxes are now of considerable complexity their function is simply to convert a source of a fibre suspension into a flat jet of uniform consistency, velocity, direction and thickness and to deliver that jet uniformly across the wire section. The delivery from the head box to the wire section takes place at a slice nozzle arrangement consisting of two lips. Normally one lip is fixed although it may be movable in the direction of the flow. Movement in the direction of the flow, when present, controls the angle of impact of the jete onto the wire.

The second, usually the upper, lip may be attached to a movable front wall of the head box so that it may be moved substantially perpendicularly to the flow to vary the gap formed by the lips. The upper lip is almost invariably movable in modern paper making machines to provide means for controlling the thickness of the jet across the width of the slice. This is normally done by deforming the flexible lip at points at approximately 4 to 12 inch intervals across the width of the slice.

Typically this deformation is achieved by several rods attached each at one end to the flexible lip and connected at its other end to a screw jack mounted on a fixed surface. By altering the position of the screw jacks the length of the rod is varied and the position of the lip thus varied. By varying the length of the rods across the width of the slice nozzle the lip contour and thus the slice opening profile, the configuration of the slice opening in the cross machine direction, can be varied.

Unfortunately the control obtainable with this arrangement is restricted by the threads of the screw jack assembly, by backlash in the connection to the slice lips, by backlash due to wear of the threads and, where motorized drive of the screw jack is used, by backlash in the drive and in the coupling.

However it is important to have fine control of the slice lip contour. Because of thermal expansion and, partly, due to built-in stresses in the construction material used for the lips and the walls, unacceptable flexing and buckling of the lips can occur when the temperature changes, for example during machine start up. This must be corrected to produce a jet of uniform thickness and velocity and a paper of acceptably uniform fibre and moisture distribution in the cross machine direction.

Although the average basis weight over the width of the machine is fairly insensitive to jet velocity, or to average slice opening, and mainly a function of head box stock consistency, this is not the case for local variations in slice openings across the width of the nozzle. These local variations will act as local flow restrictions without a corresponding local build up of head box pressure. This results in a deposition of a thinner jet, that is with less fibres, and thus variations in the sheet basis weight across the width of the machine.

Imperfections in the design of the head box can give rise to unwanted effects in the flow in the head box leading to the slice region. These defects can include cross machine variations in consistency, velocity and flow direction, all of which may pass out from the slice in a more or less dampened form. It is essential to have a slice lip contour adjustment to be able to combat these defects.

Increased paper machine width, increased paper machine speeds and more stringent specifications concerning uniformity of paper have recently put more demand on the performance of cross machine controls for paper basis weight. This has lead to computer control of sheet basis weight although computer control of basis weight has until recently generally been restricted to the machine directional control by control of head box consistency. However recently systems have been developed for the computer control of paper basis weight by automated slice lip contour control.

To provide the slice lip contour control the general approach has been to reduce backlash by using wear resistant material and improved couplings and to improve the positioning by using higher gear ratios in the screw jack, improved position indicators and better motor control. While these improvements have led to greater accuracy further improvements are necessary if ideal cross machine automatic basis weight control through slice lip contour control is to be achieved.

The above methods of control are essentially mechanical. However a system available under the trade mark THERMATROL features a rod that is electrically heated on parts of its periphery. The heating is controlled by varying the voltage to the heating element around the rod. As the rod expands and contracts with change in temperature quite good slice lip contour control is achieved. Backlash from motor couplings and screw jack threads and the like is eliminated and the system lends itself to simple computer control. However there are still disadvantages. There is the disadvantage of thermal drift. Metal rod conductivity causes heating of the rod and the connections outside the heating zone. Variations in the ambient air temperature and velocity cause variations in the effective length of the rods and thus interfere with the performance of the control system.

A further disadvantage with the electric heating of the rod is that the magnitude of available control is a direct function of the co-efficient of thermal expansion of the material used in the rod, the length of the rod and the temperature increase. The rate of response of such a rod is the function of cool down rate of the rod. A typical response period is about 30 minutes and this is undesirably slow. Further the magnitude of control available is limited for practical purposes to about 0.08 inches.

Thus for many applications, and in particular the application of these devices for lip control in paper machine head boxes, it is desirable to have considerably better performance than that presently available from a simple heated rod. Both the magnitude and speed of response needs to be improved. Further an indication of the final output movement should be available.

SUMMARY OF THE INVENTION

The present invention seeks to avoid the disadvantages in the prior art. In particular the present invention seeks to provide a means of considerably increasing the rate of response, greatly amplifying the linear movement available at the lip and further saving energy in operating the device. The device of the present invention also exhibits zero backlash because of the connections possible.

Accordingly, in a first aspect the present invention is a control mechanism comprising a rod; means to heat the rod to expand it; a first flexible vessel of a first cross section communicating with the rod; a second flexible vessel of a second cross section different from the first cross section communicating with the first vessel; a substantially imcompressible fluid within the first and second vessels; whereby movement of the rod against the first vessel moves liquid to the second vessel, the differing cross sections ensuring that the longitudinal movement of the second vessel is different from that of the rod.

In a more specific aspect the present invention is a control for a lip of a head box slice the control comprising; a first rod; means to heat the rod to expand it; a first flexible vessel of a first cross section communicating with the rod and compressible by expansion of the rod; a second flexible vessel communicating with the first and of a second cross section different from the first cross section; a substantially incompressible fluid within the first and second vessels; a second rod communicating with the second vessel and extending towards the lip, whereby linear expansion of the first rod is modified by the first and second vessels to move the second rod a distance different from that moved by the first. Usually both aspects have the second cross section area smaller than the first to magnify the movement of the rod that is heated.

BRIEF DESCRIPTION OF THE DRAWINGS

The invention is illustrated, merely by way of example, in the accompanying drawings in which:

FIG. 1 illustrates a general layout featuring the control mechanism of the present invention;

FIG. 2 is a partial section through the control mechanism according to the present invention;

FIG. 3 illustrates a detail useful in a further embodiment of the present invention;

DESCRIPTION OF THE PREFERRED EMBODIMENTS

Figure 4:
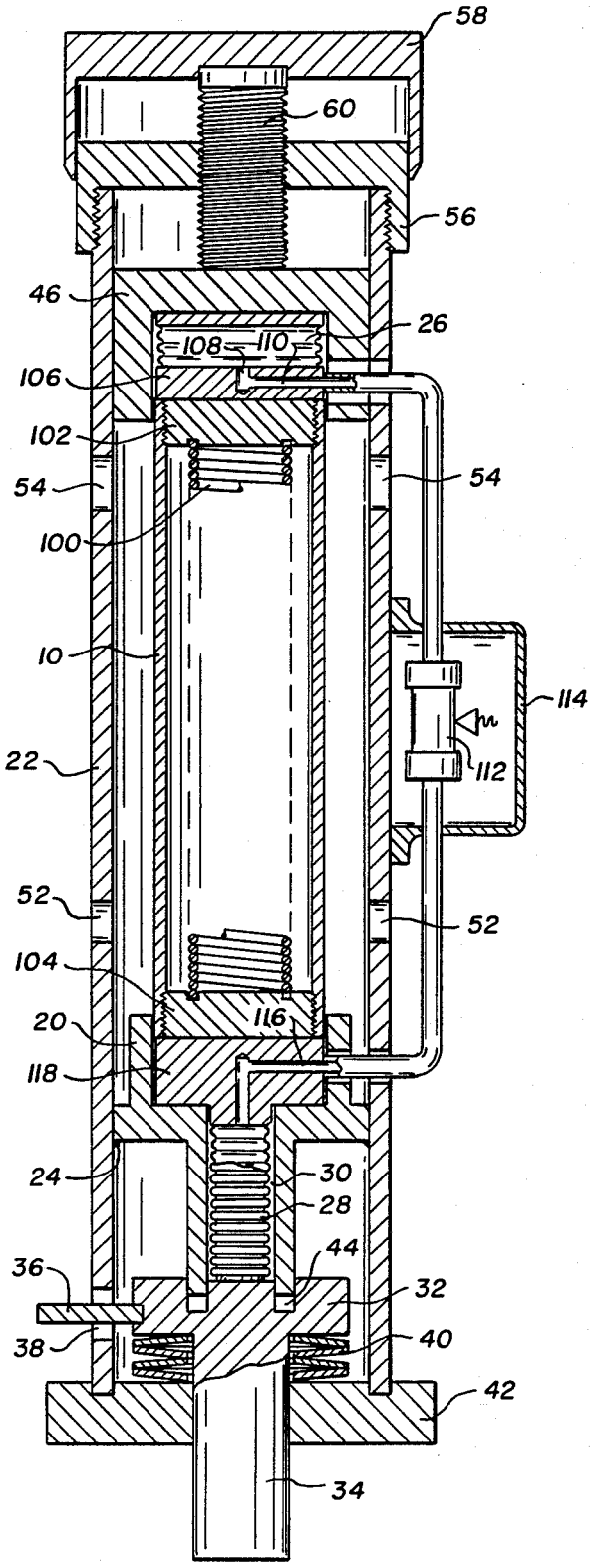
FIG. 4 illustrates a further embodiment of the invention in a view similar to FIG. 2.

FIG. 1 merely illustrates the environment of the invention and shows control mechanisms 2 arranged at centers, typically for example four to twelve inches, along the lip 4 of a slice box.

Referring to the more detailed view, FIG. 2, there is shown heating means in the form of an induction coil 8 positioned within an expandible rod in the form of a first tube 10 attached to a plate 12. Plate 12 is also provided with recesses 14 to assist in the location of the induction coil 8. At its bottom end tube 10 is threadedly engaged in an abutment 16. The abutment 16 is provided with recesses 18 also to locate the induction coil 8. The power source for the induction coil 8 is not shown. It will be appreciated that the induction coil 8 is conventional.

The abutment 16 and tube 10 are slidably received in housing 20 which is welded to a second tube 22 at 24. A first bellows 26 communicates with a second bellows 28. Bellows 28 is of relatively smaller cross-sectional area than bellows 26 and is located within channel 30 of housing 20. The second bellows 28 abuts a flange 32 positioned at the top of rod 34. The rod 34 extends to lip 4 as shown in FIG. 1. Flange 32 is formed with an indicator 36 extending through an opening 38 in outer tube 22 and there is a spring 40 located beneath the flange 32 and above bottom end cap 42 of outer tube 22. Flange 32 has slots 44 to receive and slidably locate the walls of housing 20 that define channel 30.

At its upper end the tube 10 is threadedly engaged within piston 46, which has a slot 48 at one side and a threaded opening 50 extending through its centre. Outer tube 22 is provided with a key 51 extending inwardly to engage in the slot 48 in piston 46. Both the inner and the outer tubes 10 and 22 are provided with inlets 52 adjacent their bases and outlets 54 adjacent their tops.

The outer tube 22 is threadedly received in internally threaded cap 56 over which handwheel 58 can rotate. Handwheel 58 is provided with a differential thread assembly comprising a first thread 60 attached to handwheel 58 and extending through a threaded opening 62 in cap 56. A second, thread 64 of pitch different from thread 60 extends through the threaded opening 50 in the piston 46.

Cap 56 may be calibrated at 66 and handwheel 58 may be calibrated at 68.

The bellows 26 and 28 are filled with a substantially incompressible fluid. Typically a hydraulic oil will be used.

The device operates as follows:

First a relatively rough adjustment of each control mechanism 2 is established by turning the handwheel 58 clockwise or anti clockwise, as necessary. It will be appreciated that the known differential thread mechanism gives quite sensitive control of the position of the first tube 10. Furthermore movement downwardly of the tube 10 under the influence of the handwheel also incorporates the advantage of the hydraulic amplifier made up of vessels 26 and 28 that is a principal feature of this invention.

During turning of the handwheel 58 and thus rotation of the threads 60 and 64, key 51 acting in slot 48 prevents rotation of the piston 46 and ensures that the movement of the piston 46, and thus of the inner tube 10, and the abutment member 16 is longitudinal to act on the bellows 26.

Once a coarse position has been established the current to the induction coil 8 is switched on. As a result the tube 10 heats and expands. It pushes the abutment 16 member downwardly in housing 20 to compress the first bellows 26. If, for example, the first bellows has a diameter twice as large as that of the second bellows then a downward movement of the first rod, under the influence of expansion, will result in a fourfold downward movement in the second rod.

Control of the temperature is achieved by cooling air entering through inlets 52, passing over the induction coil 8 and the tube 10 and leaving through outlets 54. The heated tube 10 will, of course, provide a chimney effect to induce the necessary flow of air.

The position of the lip 4 can be assessed from indicator 36 projecting through opening 38. Lifting of the lip 4 is achieved by reducing the temperature of the coil and thus of the tube 10. With the cooling compressed spring 40 acts upwardly against flange 32 to raise the rod 34 and thus the lip 4.

FIG. 3 illustrates an important variation. A passageway 70 extends downwardly from the first bellows 26 and a passageway 72 extends upwardly from the second bellows 28. A cross passage 74 is formed with a chamber 76 housing a ball 78. A control arm 80 for the ball 78 extends outwardly through housing 82. The housing is sealed by O rings 84. There is a handle 86 at the end of the arm 80. Further sealing is by cap 88.

The variation in FIG. 3 is useful, for example, where there is a power failure so that no heating is available. In those circumstances backward movement of the fluid from the second bellows 28 to the first bellows 26 can be avoided by pressing inwardly on handle 86 to move the ball 78 to the left of chamber 76 as shown in FIG. 3 preventing communication between passageways 70 and 72. The pressure developed in bellows 28 on contraction of the tube 10 and thus on expansion of the first vessel 26 will be considerable and establish a considerable pressure gradient between the bellows 26 and 28. Thus ball 78 will be held against the passageway 74, sealing it. In this way the worst effects of uncontrollable cooling can be avoided. It should be noted that although a hand arrangement is shown for FIG. 3 shaft 80 can be moved by, for example, a solenoid.

It should also be noted that in the embodiment of FIG. 3 the first bellows should be anchored at 90 within the housing 20.

The embodiment of FIG. 4 resembles the embodiment of FIG. 2 and the same reference numerals are used for common features.

However it should be noted that in the embodiment of FIG. 4 a first vessel 26 is positioned at the top of the tube 10 and the second vessel 28 is positioned at the same position at the bottom of the tube 10, as in FIG. 2. Furthermore in FIG. 4 a heating coil shown schematically at 100 is used to provide resistance heating of the tube 10.

In the embodiment of FIG. 4 tube 10 is provided with a top abutment 102 and a bottom abutment 104 threadedly engaged at each end. At the top there is a plate 106 provided with a passageway 108. The passageway 108 communicates with a second passageway 110 extending through a solenoid operated check valve 112 located in housing 114. The passageway 110 communicates with a further passageway 116 located in member 118 positioned within housing 20. The passageway 116 communicates with the interior of the second vessel 28.

The operation of the control of FIG. 4 is as described for FIG. 2. It should be noted that although the check valve 112 is shown in position in FIG. 4 it need not be present. That is communication between the first and second vessels can be free as shown in the FIG. 2 embodiment. Furthermore the inlets 52 in the base of the tube 10 shown in FIG. 2 are not present in FIG. 4, where resistance heating is used. As is believed clear from the preceding description heating of the rod, in the form of tube 10, expands the tube upwardly against member 106 to compress first vessel 26. Fluid is then forced out of the vessel 26, through the passageways 108, 110 and 116. into the second vessel 28 to expand it. By this means control of the movement of the rod 34 is achieved. It should be noted that the same coarse control arrangement using differential threads is present in the FIG. 4 embodiment but is not shown in the same detail as in FIG. 1.

Figure 5:
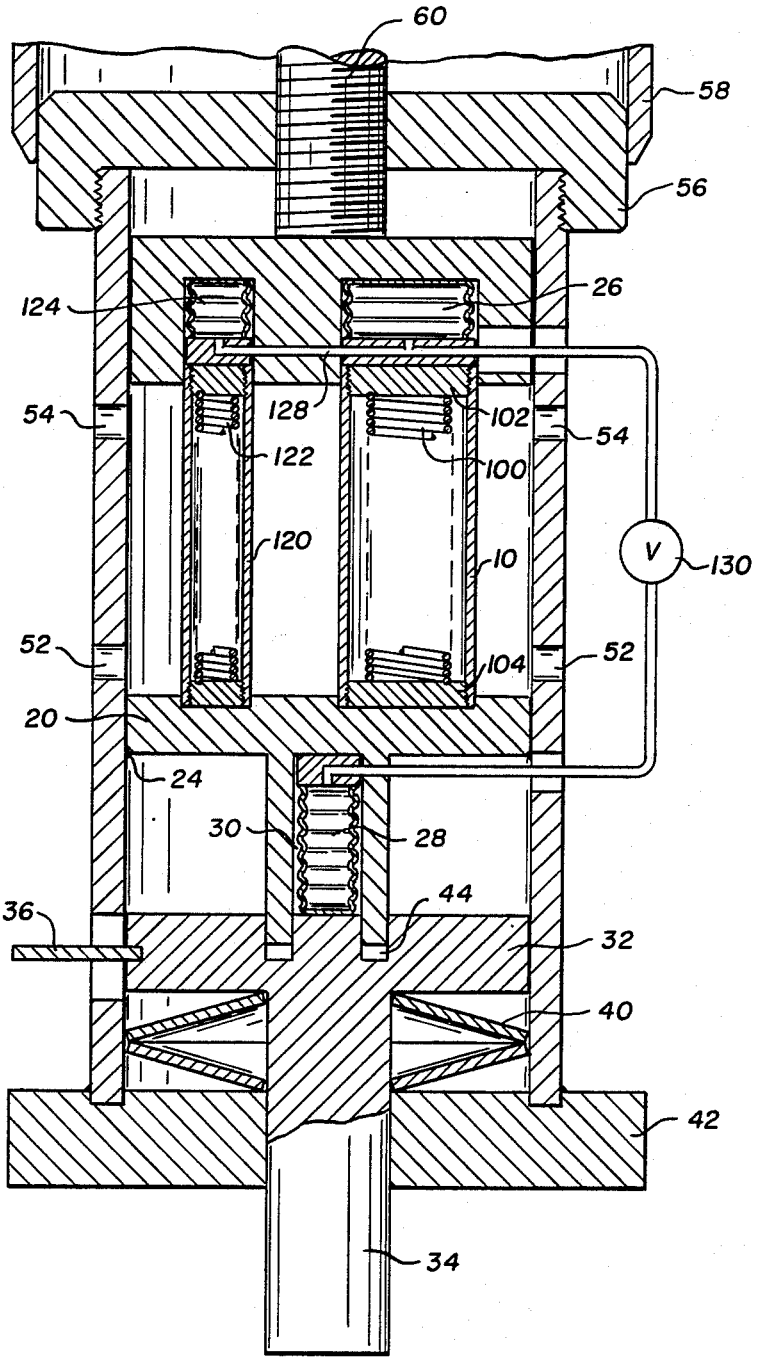
FIG. 5 illustrates a further embodiment of the present invention.

FIG. 5 illustrates an embodiment of the invention differing from the previous embodiments in one important respect. For the rest the same reference numerals are used for any part also found in the previous embodiments.

The embodiment of FIG. 5 features a further rod 120 provided with a further induction coil 122 to heat it. A further vessel 124 having a cross-section smaller than the vessel 26 communicates with the rod 120. A passageway 128 communicates both with the vessel 124 and with vessel 26. The passageway passes to the second vessel 28 through check valve 130.

The embodiment of FIG. 5 operates in principle the same as the previous embodiments. However it makes possible a control whereby rod 10 is heated to obtain fast positioning but, once the position has been largely established fine control and good resolution is obtained by controlling the temperature of the rod 120. For example heating power to rods 10 and 120 can be such that power to the rod 120 is set to be about 10% of the power to the rod 10. When the position of the lip, established through rod 34, is accurately set then the power to rod 10 can be held constant and the power to rod 120 is then controlled to maintain this setpoint. Settings using the second rod 120 of less than 0.001 inches can be obtained. The arrangement which may, for example, be controlled through a computer acting through lip position sensing means can be arranged so that if a variation from the setpoint of, for example, 0.002 inches is achieved then the second rod 10 is again expanded until the set position is re-established.

Thus the embodiment of FIG. 5 offers fast response using rod 110 and then extremely fine control and resolution of the position of the lip by rod 120.

An important point is that the cross section of vessel 124 is shown smaller than that of vessel 26. However this need not be so. The cross sections could, for example, be the same as the compositions of rods 10 and 120, or the dimensions of the two rods, can be different from each other so their expansion properties are different. Thus the important point is that the expansion characteristics of the combination of rod 120 and vessel 124 be different from the expansion characteristics of the combination of rod 10 and vessel 26.

The present invention acts on feedback from the basis weight at the reel and/or from the indicator 36. This feedback will provide the data required to determine if the slice lip 4 should move up or down.

In the present invention the movement of the slice spindle 34 is a function of the cross-sectional areas of the first and second bellows 26 and 28 rather than of the characteristics of the tube 10. In addition to the amplification of the linear motion the response time is increased by the same rate.

A further advantage of the invention is that the size of the control is smaller than with prior art apparatus. The size required is a function of the hydraulic components comprising the bellows which is relatively small. Thus for any given required movement the size of the control mechanism can be considerably smaller than corresponding prior art equipment able to provide the same linear movement. The reduction in size of the tube 10 also aids the speed of response as the mass of the tube 10 is less. Thus the heat up and cool down times are correspondingly less. Considerable energy savings are thus possible.

By selection of the proper spring 40 it is possible to safeguard the lip 4 from over stress. Over stress of the lip 4 results when the magnitude of the lip displacement between adjacent spindles 34 is beyond tolerable limits. This relative displacement can be controlled by the spring 40 if the spring force is such that if a spindle 34 moves too far relative to its neighbouring spindle the force transmitted to the adjacent spindle, via the lip, which acts like a beam, is sufficient to deflect the spring 40 and transmit relative displacement.

The device readily makes direct manual control possible and the calibrations 66 and 68 on the illustrated embodiments means that reading of the required movement can be taken directly off the handwheel 58 which provides a backup to the indicator 36.

The embodiment of FIG. 3 provides a means of maintaining the lip position without external control. This can be extremely important as explained above.

An important point is that although first vessel 26 is shown in the drawings as of greater cross section than second vessel 28 the reverse may apply to provide a mechanism in which the movement of tube 10 an expansion is reduced by the vessels 26 and 28.

Thus the present invention provides a control mechanism that is more efficient and yet more economical than prior art equipment. It is more economical of space, that is it is smaller than control mechanisms of the same linear capabilities in the prior art.

I claim:

1. In the combination of a flexible lip of a headbox slice on a papermaking machine with an automated computer cross directional control of basis weight of a sheet of paper during the manufacture of the paper sheet on the machine, wherein the flexible lip is moved substantially perpendicular to the flow of the fiber suspension from the headbox, to vary the position of the flexible lip at points along the lip at spaced intervals across the width of the slice, the improvement comprising:

a first rod attached at one end to a fixed surface of said headbox at each of said intervals;

means to heat each first rod to expand it so that the other end will move in a linear direction;

a first flexible vessel of a first cross section abutting each first rod and compressed by the expansion of the rod, each flexible vessel having a longitudinal axis aligned with the longitudinal axis of the abutting rod;

a housing to slidably receive each first vessel so that each first vessel can expand and slide in its housing only in said linear direction to increase pressure within each first vessel;

second flexible vessels of a second cross section different from the first cross section;

means communicating pairs of first and second flexible vessels;

a substantially incompressible fluid within each first and each second vessel;

a second rod abutting each second vessel and having a longitudinal axis in line with a longitudinal axis of the abutting rod, each second rod extending towards and attached to a point on the lip;

a housing to slidably receive each second vessel so that each second vessel can expand and slide in its housing so that pressure transmitted from a first vessel to a second vessel by expansion of a first rod will move he second rod in the same linear direction as the first rod a distance different from that moved by the first rod, the movement being essentially free from backlash.

2. A control as claimed in claim 1 in which the means to heat each first rod comprises an induction coil.

3. A control as claimed in claim 1 in which the means to heat each first rod comprises resistance heaters associated with each rod.

4. A control as claimed in claim 1 in which the first and second flexible vessels are bellows communicating with each other.

5. A control as claimed in claim 1 in which the first cross section is greater than the second so that expansion of each first rod against a first vessel of a pair ensures greater longitudinal movement of the second vessel of the pair than of the first rod.

6. A control as claimed in claim 1 in which each first rod is positioned within a casing;

means defining inlets at the base of the casing, means defining outlets at the top of the casing;

the inlets and outlets permitting air to pass over the rod to cool it, the heat of the rod facilitating airflow by the chimney effect.

7. A control as claimed in claim 1 including resilient means tending to urge each second rod upwardly, against the action of the expansion of each first rod.

8. A control as claimed in claim 7 in which the resilient means comprises a coil spring.

9. A control as claimed in claim 1 including an indicator, externally visible, to show the position of each second rod.

10. A control as claimed in claim 1 in which each first vessel is of larger cross section than the second of the pair and is positioned at the top of a rod when the control is in its useful position;

the second vessel, of smaller cross section, being at the bottom of the rod when the control is in its useful position.

11. A control as claimed in claim 1 including a plurality of third rods;

means to head each third rod;

a third flexible vessel communicating with each third rod and with each second flexible vessel;

the combination of third rod and third vessel having different expansion properties on heating the third rod from the expansion properties of the combination of the first rod and first vessel whereby the sensitivity of the control of longitudinal movement of the second rod is increased.

12. A control as claimed in claim 11 in which each third flexible vessel has a cross section different from the first cross section.

13. A control as claimed in claim 12 in which the first and third rods are of different dimensions.

14. In the combination of a flexible lip of a headbox slice on a papermaking machine with an automated computer cross-directional control of basis weight of a sheet of paper manufactured on the machine, a control for the lip of the headbox slice comprising:

a first rod attached at one end to a fixed surface of the headbox;

means for heating the first rod to expand it in a linear direction;

a first flexible vessel of a first cross-section adjacent the first rod and compressible by expansion of the first rod, said first flexible vessel compressible only in the linear direction of expansion of the first rod;

a second flexible vessel communicating with the first flexible vessel and having a second cross-section different from the first cross-section;

a substantially incompressible fluid contained within the first and second flexible vessels;

a second rod abutting the second vessel and extending towards and attached to the flexible lip, such that linear expansion of the first rod compresses the first flexible vessel, expands the second flexible vessel, and thereby moves the second rod a distance different from that moved by the first rod and in the same linear direction of expansion of the first rod.

* * * * *